US005396827A

United States Patent [19]

Miller et al.

[11] Patent Number: 5,396,827

[45] Date of Patent: Mar. 14, 1995

[54] TUNER WITH VARIABLE TUNING WINDOW

[75] Inventors: Gary Miller; Doran M. Oster; Charles G. Crampton, all of Gainesville, Fla.

[73] Assignee: Sabine Musical Manufacturing Company, Inc., Gainesville, Fla.

[21] Appl. No.: 261,955

[22] Filed: Jun. 17, 1994

[51] Int. Cl.[6] ..... G10G 7/02

[52] U.S. Cl. ..... 84/454; 84/DIG. 18

[58] Field of Search ..... 84/454, 477 R, DIG. 18; 324/76.51

[56] References Cited

U.S. PATENT DOCUMENTS

| | | | |
|---|---|---|---|
| 3,861,266 | 1/1975 | Whitaker | 84/454 |
| 4,018,124 | 4/1977 | Rosado | 84/454 |
| 4,271,746 | 1/1981 | Dobbie | 84/454 |
| 4,331,060 | 5/1982 | Allen | 84/454 |
| 4,399,732 | 8/1983 | Rothschild et al. | 84/454 |
| 4,523,506 | 1/1985 | Hollimon | 84/454 |
| 4,796,509 | 1/1989 | Mizuguchi et al. | 84/454 |
| 5,056,398 | 10/1991 | Adamson | 84/454 |

*Primary Examiner*—Michael L. Gellner
*Assistant Examiner*—Patrick J. Stanzione
*Attorney, Agent, or Firm*—Donald W. Marks

[57] ABSTRACT

An electronic tuning device has selectable width tuning ranges wherein selected pairs of the LEDs in a single row of LED's are activated, such as being turned on, blinked or flashed, so that the spacing between each activated pair of LEDs indicates the width of the tuning range during a range indicating mode. The sensing of a fundamental frequency of an input tone causes the operation of a corresponding LED in the row of LEDs to indicate the nearest note along with in-tune and out-of-tune conditions.

9 Claims, 5 Drawing Sheets

| ACTIVATED LEDs | IN-TUNE WINDOW WIDTH (CENTS) |
|---|---|
| A & G# | ±49 |
| A# & G | ±40 |
| B & F# | ±30 |
| C & F | ±20 |
| C# & E | ±10 |
| D & D# | ±5 |

TUNER WITH VARIABLE TUNING WINDOW

BACKGROUND OF THE INVENTION

1. Field of the Invention

The present invention relates to tuning devices for musical instruments and singers, and more specifically, to electronic tuning devices for indicating the tuning of almost any type of musical instrument including band and orchestra instruments such as wind instruments along with stringed percussive instruments like guitars, pianos, harps, etc.; electronic musical instruments which have microphone pickups and amplifiers to generate acoustical sound vibrations in the air by speakers; and musical notes produced by a singer.

2. Description of the Prior Art

Traditional tuning of instruments is often done with one or more tuning forks, or other accurate tone sources, and a trained ear. In this process, the artisan often uses the phenomenon of "beats" to fine tune the instrument. A beat is an apparent oscillation of the loudness of a perceived tone when that tone is produced by two simultaneous tones of nearly, but not exactly the same frequency. Beats occur at a frequency equal to the difference between the two generating frequencies. For example, if a tuning fork is vibrating at a frequency of 440 Hz (440 cycles per second or in musical terms an A note) and a piano string is simultaneously vibrating at a fundamental frequency of 443 Hz, a definite rising and falling in the volume of the perceived tone will occur at a rate of three cycles per second. As the two tones approach the same frequency the beat frequency will reduce to zero. At a beat frequency of zero there is simply no variation in the volume of the combined tone. When a beat frequency occurs there is no way to tell which of the two tones (the tuning fork or the piano) is the higher frequency. When a three Hertz beat occurs the technician can only be sure the string is three Hertz off from the standard tone. Whether the string is sharp or flat still had to be determined by ear. Many times a trial adjustment was made and if the beat got faster, the knowledge was gained that the adjustment was in the wrong direction. The traditional method of tuning instruments left a lot to be desired and was entirely dependent on the skill of the tuning technician.

An electronic tuner for musical instruments has been marketed by Sabine Musical Manufacturing Company, Inc. of Gainesville, Fl. since about 1987. For tuning traditional musical instruments, i.e. non-electronic instruments, the tuner is set on a table top and uses a built-in microphone to sense tones produced by the musical instruments. For tuning electronic instruments, a signal output from the instrument or amplifier is directly connected by a cable to the electronic tuner. The LED display of this prior art tuning device consists of a bottom row of twelve lights corresponding to the twelve musical notes in an octave, i.e. A, A# (Bn), B, C, C# (Db), D, D# (Eb), E, F, F# (Gb), G and G# (Ab). A separate top row of three lights is provided for indicating flat, in-tune or sharp tuning conditions, respectively. One of the twelve LEDs in the bottom row is lit to indicate the note of the incoming tone while one LED in the upper row is lit to indicate whether the incoming tone is in-tune, sharp (above the in-tune range), or flat (below the in-tune range). The flat and sharp error indicating lights are operated at blink rates proportional to the magnitude of error. During tuning the musician must constantly monitor both rows of LED's, and in the absence of such concentration, a change to the wrong note can be overlooked resulting in tuning of the instrument or string to the wrong note.

Electronic tuning devices of the above type generally have a relatively small in-tune range or window, for example plus or minus three or four cents, in order to prevent annoying beat frequencies and dissonance between tuned instruments. Such tuning devices are most suitable for string instruments such as guitar, piano, harp, etc. However, these tuners are generally not used in tuning band and orchestra instruments such as wind instruments including brass instruments and woodwinds like single and double reed instruments and flute type instruments. Only highly experienced or talented band and orchestra musicians can hold a tone within plus or minus four cents on wind instruments. There is a need for beginners and students in bands or orchestras, such as high school bands and orchestras, to have a low cost tuner producing a visual indication of the in-tune or out-of-tune condition of their instruments, particularly those playing wind instruments. Additionally there is a need for a similar tuner for indicating musical notes produced by singers during practice and the deviation of the vocal notes from standard musical notes.

The prior art, in U.S. Pat. No. 3,861,266, discloses a musical tuning instrument for persons of lesser skill, such as members of high school bands. The tuning instrument has selector switches for setting the frequency (note) and sensitivity. When sensitivity is set at the most sensitive position, a pattern of eight lit LEDs in a circular array of sixteen LEDs rotates once per second when the incoming tone is exactly one Hertz greater or less than the set frequency. At the least sensitive position, the one second rotation of the pattern occurs when the incoming tone is sixteen Hertz greater or less than the set frequency.

SUMMARY OF THE INVENTION

The invention is summarized in an electronic tuning device for a musical instrument wherein the tuning device has a variable in-tune range which, in one mode, is indicated by lights in a display of a row of light sources. When an incoming tone is sensed by a transducer, one light in the row of lights is lit in a second mode to indicate the corresponding musical note. The light indicating the musical note is also operated in a manner, such as by blinking and/or selective color emission, to indicate the in-tune or out-of-tune condition of the incoming tone.

Accordingly, it is a principal object of the invention to provide a musical instrument tuning device with selectable in-tune ranges enabling use by beginners, students and accomplished musicians to tune band and orchestra instruments and voice.

Another object of the invention to provide an electronic tuning device with a single row of display lamps, such as light emitting diodes (LEDs), which indicate the width of a tuning window along with the frequency or note of a incoming tone and its in-tune or out-of-tune condition.

One advantage of the invention is that the spacing between a pair of energized light emitting sources in a row of light emitting sources indicates the width of a set in-tune range.

Another advantage of the invention is that an in-tune range or window is selected by depression of a calibration or range switch to step a tuner through the selectable in-tune ranges.

Additional features of the invention include the provision of three-color light sources for indicating notes in a scale of notes wherein the color indicates sharp, flat and in-tune conditions of the notes; the provision of blinking light sources for indicating notes in a scale of notes wherein the frequency of the blinking light indicates the deviation of the incoming tone from the nearest note.

Other objects, advantages and features of the present invention will be apparent from the following detailed description of the preferred embodiments and the accompanying drawings.

DETAILED DESCRIPTION OF THE PREFERRED EMBODIMENTS

Figure 1:
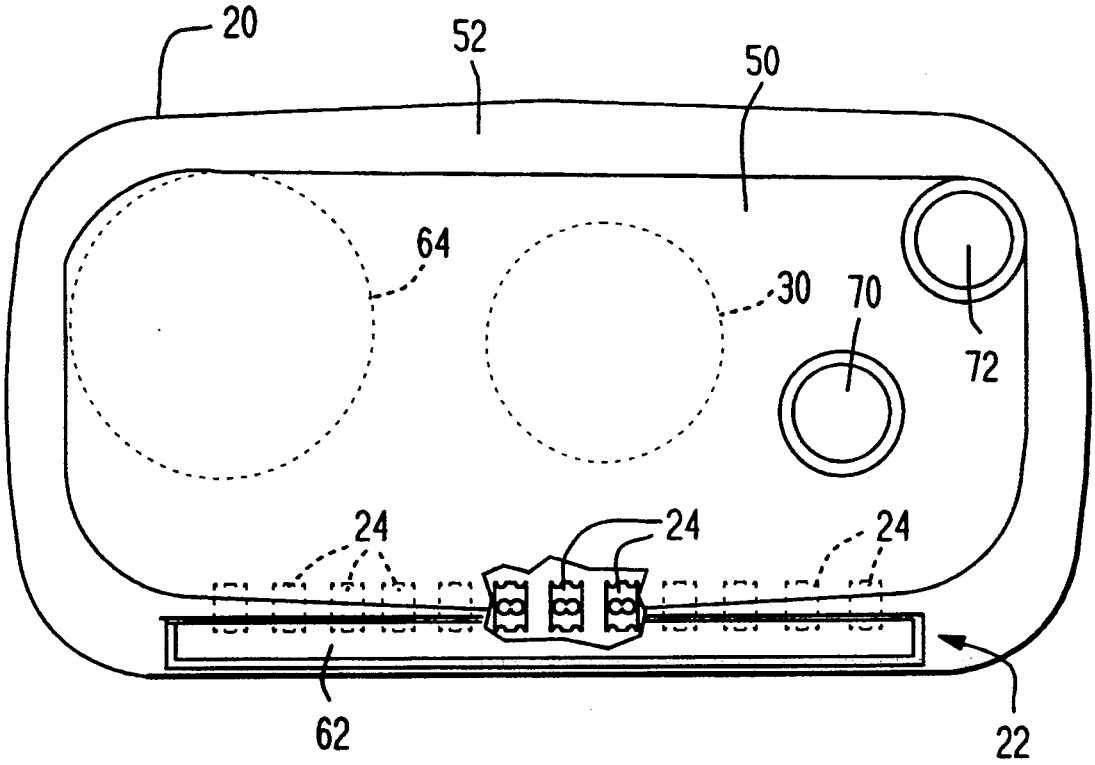
FIG. 1 is top plan view with a portion broken away of an electronic tuning device in accordance with the invention.
Figure 2:
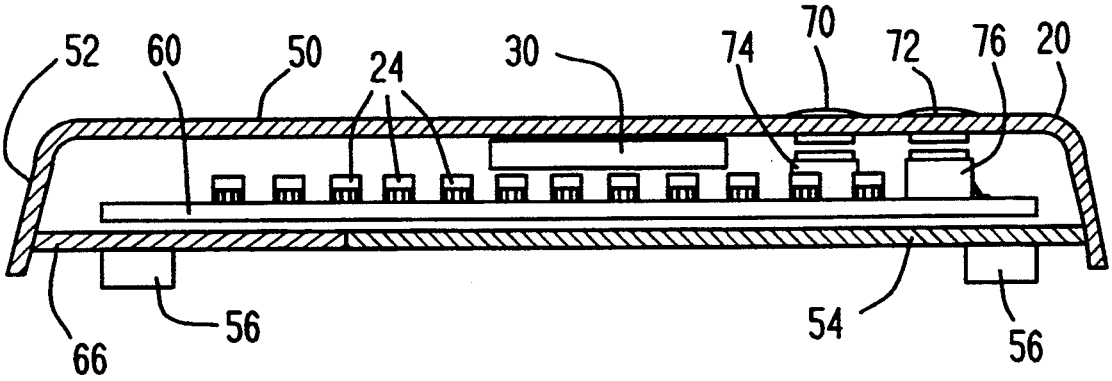
FIG. 2 is a front elevational section view of the electronic tuning device of FIG. 1.

As shown in FIGS. 1 and 2, an electronic tuner for use in tuning a musical instrument is constructed in accordance with one embodiment of the invention and includes a casing 20 in which is mounted a display, indicated generally at 22, with a row of light sources, such as twelve red-green dual light emitting diodes (LEDs) 24 which correspond to respective musical notes A, A# (Bb), B, C, C# (Db), D, D# (Eb), E, F, F# (Gb), G and G# (Ab). The tuner includes an electronic circuit 28, FIG. 3, mounted in the case 20 wherein a microphone or transducer 30 converts an incoming tone from a musical instrument into electrical signals which are amplified by an amplifier 32, filtered in a frequency response amplifier 34, detected by a zero crossing detector 36 and analyzed by a microprocessor 38 which operates the LED display 22.

In a first mode, the microprocessor 38 determines the fundamental frequency of the incoming tone, computes the nearest musical note, and operates the corresponding light source 24 in the display 22 in manner indicating the in-tune or out-of-tune condition of the incoming tone. For example, the microprocessor 38 controls the operated light source to select a color indicating an in-tune condition or a deviation such as flat or sharp condition of the tone from the nearest musical note and/or to blink the light source proportional to the deviation of the tone from the nearest musical note.

Figures 6, 7:
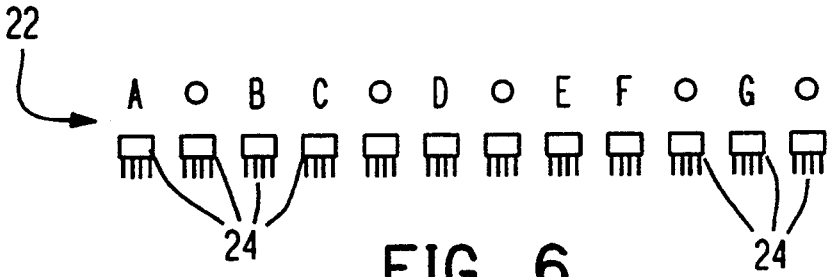
FIG. 6 is a diagram of a row of LEDs with corresponding note indicia in the electronic tuning device of FIGS. 1 and 2.
FIG. 7 is a table listing pairs of blinking lights in the light row of FIG. 6 with the corresponding in-tune range set by the electronic tuning device.

In a second mode, the processor 38 operates the LEDs in the display 22 to indicate the width of the in-tune range to which the tuner is set. One example of indicating a set range selected from several in-tune ranges is illustrated in the table of FIG. 7 wherein pairs of the LEDs 24, see also FIG. 6, are turned on, flashed or blinked; the spacing between the activated LEDs indicates the set in-tune range so that the broadest in-tune range is indicated by the LEDs A and G# on the ends of the row 22 and the narrowest range is indicated by the two innermost LEDs D and D#.

Referring back to FIGS. 1 and 2, the casing 20 has approximate outside overall dimensions of about 3 inches×1.5 inches×⅜ inch (7.6 centimeter×3.8 centimeter×1 centimeter). Casing 20 is made up of top member 50 with side walls 52 and a bottom plate 54 suitably secured in the side walls. Casing 20 is preferably molded from a durable plastic material. Side walls 52 extend slightly below the bottom edge of floor plate 54 to provide protection for the edges of rubber feet 56 which are secured on the bottom surface of the bottom plate 54.

Figure 3:
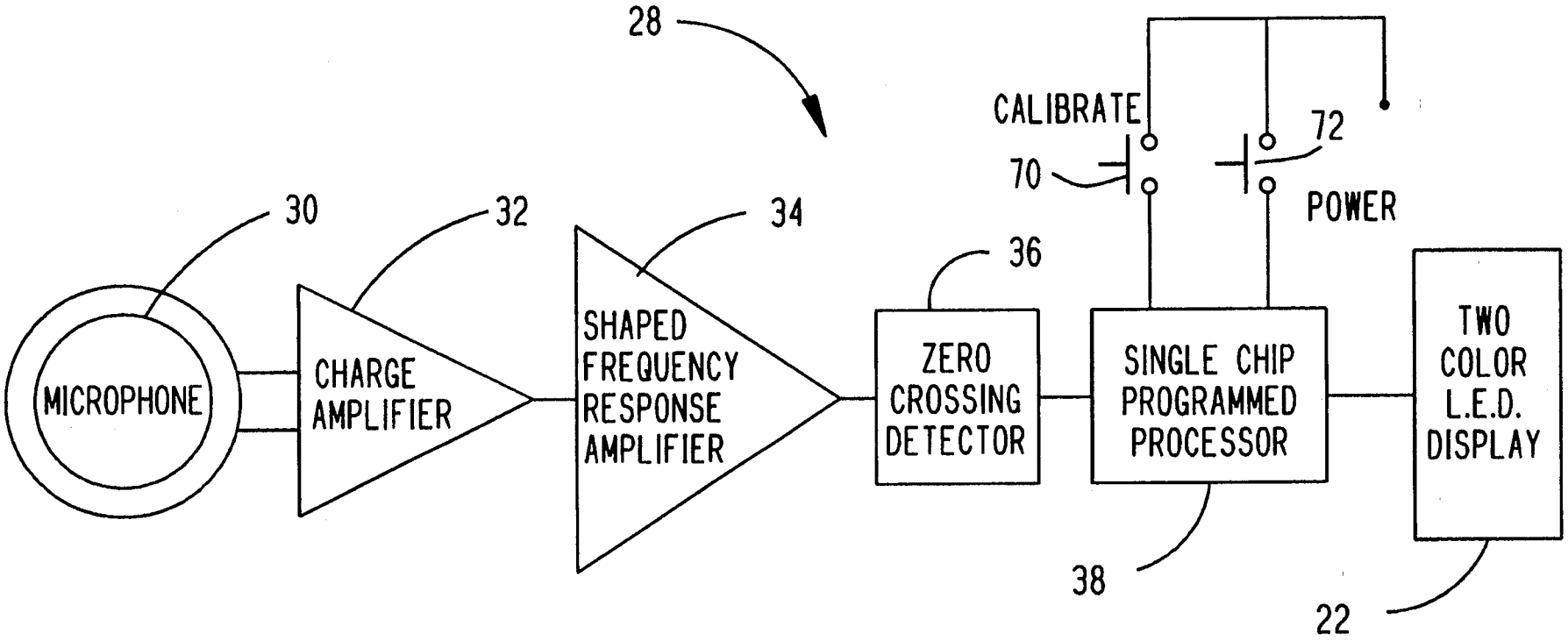
FIG. 3 is a block diagram of electrical circuitry in the electronic tuning device of FIGS. 1 and 2.

The top and bottom members 50 and 54 together with the side walls 52 define an enclosed box structure within which are mounted the electronic components forming the circuit 28 of FIG. 3. A circuit board 60 is mounted in the casing 20 and serves as a support and connection bus for the row of twelve two-color LED's 24 which selectively illuminate correspondingly labeled portions of a frosted face plate 62. Alternatively the illumination may be accomplished in many different ways such as by providing small cutouts in the top plate, by making portions of the top plate transparent, or many other ways. As shown in FIG. 6, the individual LED's may be labelled with indicia such as:

A ◯ B C ◯ D ◯ E F ◯ G ◯ where the letters represent white keys on a piano and the "◯" symbols represent the black keys. Of course the exact form of labeling is arbitrary and a matter of design choice. The scale does not have to start with A but can start with any other note such as C which would then end with B.

A battery 64, shown hidden in FIG. 1, supplies power for the electronic circuit. A door 66, FIG. 2, is provided in the bottom plate 54 for enabling the battery 64 to replaced. Top member 50 also has two openings for mounting push button range switch 70 and push button power switch 72. Suitable indicia identifying these switches are formed on top 50. Push buttons 70 and 72 are designed to make contact with inner spring biased switch elements 74 and 76, respectively, when manually depressed. As can be seen in FIG. 2, inner switch elements 74 and 76 are supported on circuit board 60. The microphone or transducer 30 is centrally mounted on the inside of the top member 54.

Figure 4:
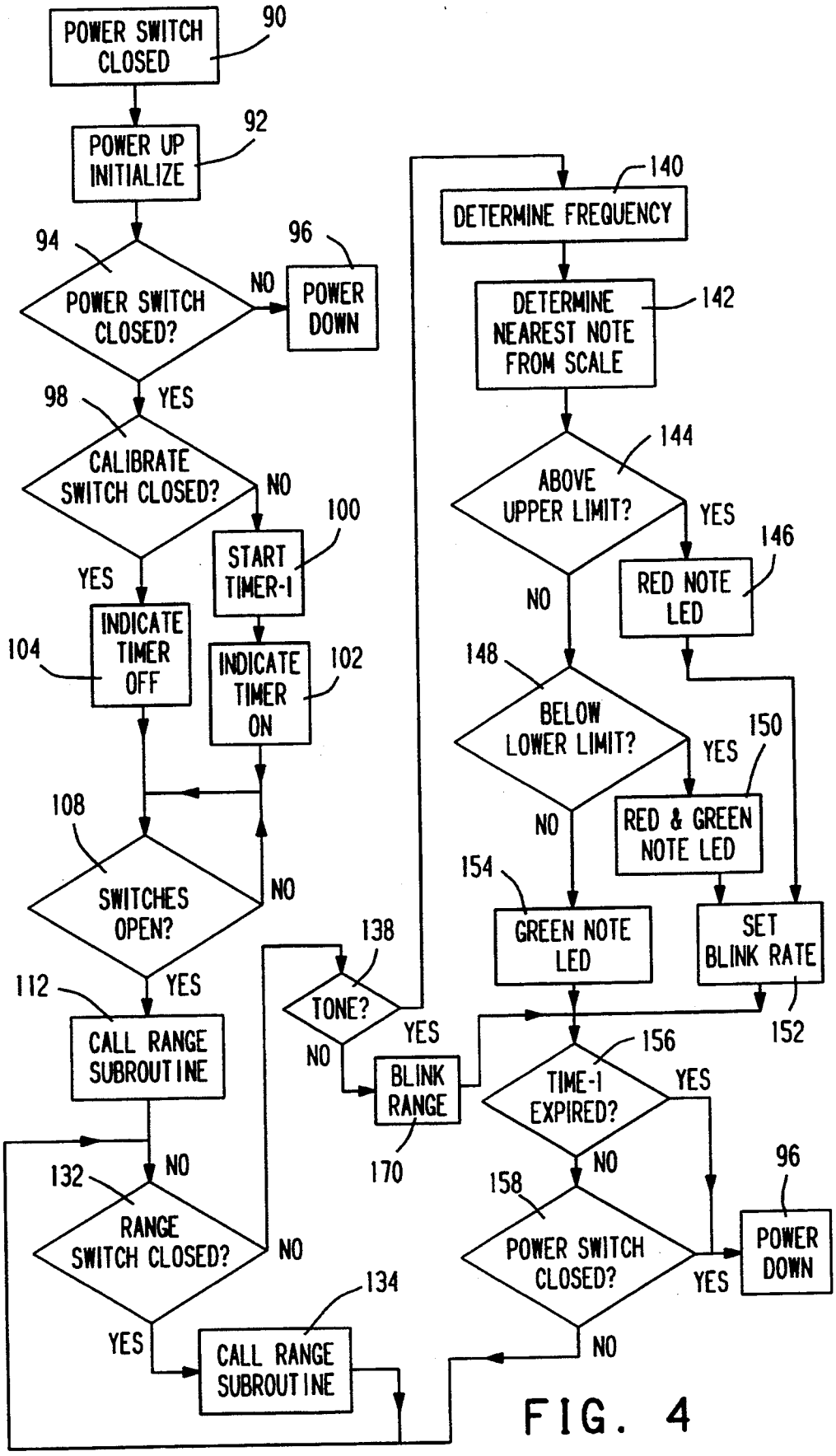
FIG. 4 is a step diagram of a program employed in a microprocessor in the circuitry of FIG. 3.

The program for operating the processor chip 38 of FIG. 3 is illustrated in FIG. 4. Operation begins at the step 90 when the power switch 72 is closed and proceeds through power up initialization 92 to step 94 where it is determined if the power switch 72 is depressed. The power switch must remain depressed sufficiently to distinguish from an incidental induced signal; otherwise the program branches to step 96 and a power down sequence. In the initialization step 92, the in-tune range is set to the widest range, for example, from plus 49 to minus 49 cents as shown in FIG. 7 corresponding to LEDs A & G#, FIG. 6. Alternatively, the set in-tune range can be set equal to the in-tune range at which the tuner was set when last turned off.

If step 94 is true, the program branches to step 98 where it is determined if the calibration or range switch 70 is also depressed. If the calibration switch is not depressed, a power shut down timer or timer-1 is started in step 100. The power shut down timer will later power down the tuner after a predetermined time, for example about ten minutes. Normal operation of the power switch 72 initiates the power down timer which automatically shuts down the tuner after the set delay. Then in step 102 the tuner indicates that the normal timer power shut-down mode, for example by momentarily turning on the green D# LED such as for one to three or more seconds. When the calibrate switch 70 is depressed before the power switch 72 is depressed and the calibrate switch is held depressed as the power switch is depressed, the program will bypass the timer-1 initiating step 100 so that the tuner can operate continuously. Continuous operation is desirable for tuning some instruments, for example, harps, pianos, etc., where more time is needed for tuning than is provided by the standard turnoff delay. In step 104, the tuner indicates the continuous mode where the normal power down mode is not active, for example by momentarily turning on both the green C# and D# LEDs such as one to three or more seconds.

Figure 5:
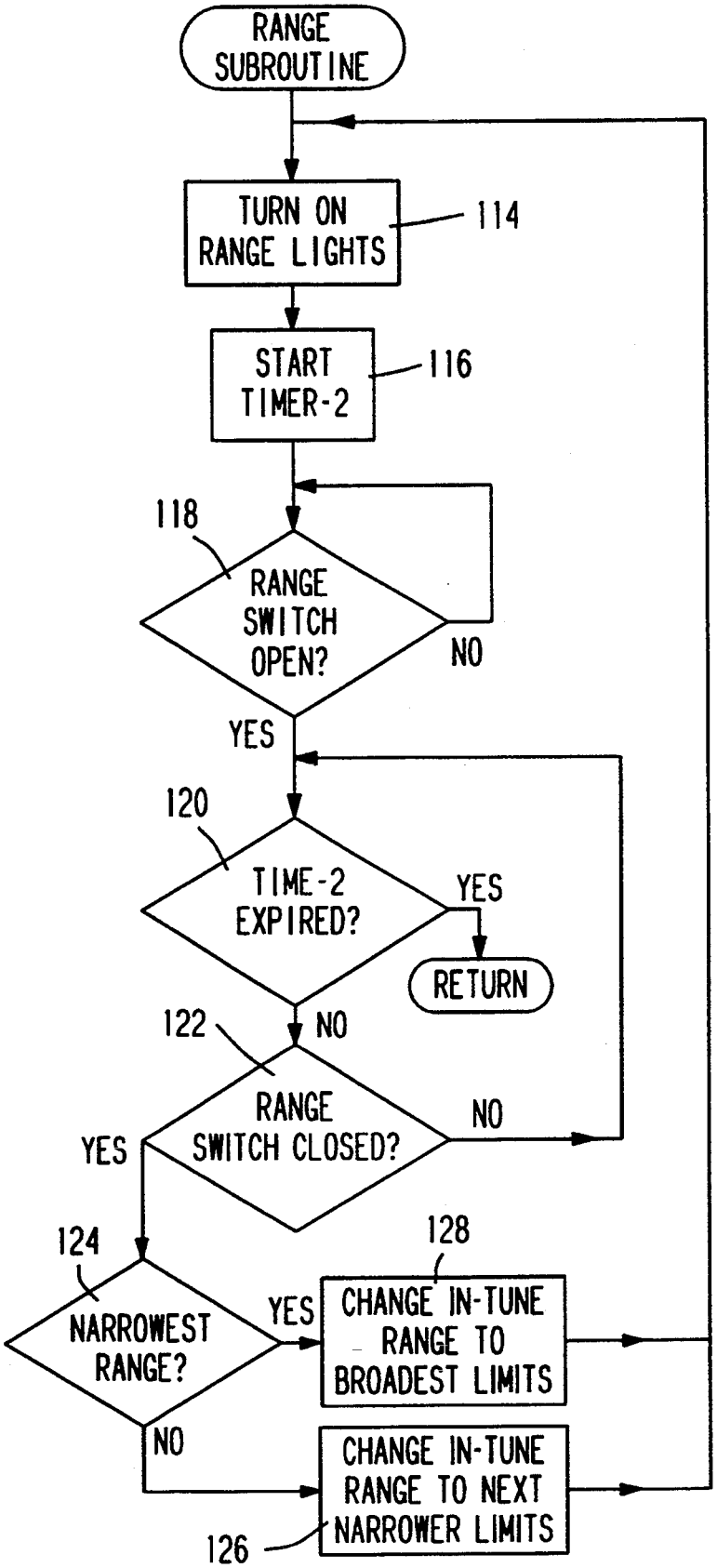
FIG. 5 is a step diagram of a subroutine called by the program in FIG. 4.

From step 102 or 104, the program proceeds to step 108 where the program waits until the power switch 72 is opened; the range switch 70 must also open before the program proceeds from step 108. After sensing the open condition of the switches, the program proceeds to step 112 where the program calls a range subroutine illustrated in FIG. 5. In step 114 of the range subroutine, the lights or LEDs illustrating the current in-tune range setting are turned on. For example, the table in FIG. 7 lists six in-tune window widths or ranges along with the corresponding LEDs used to indicate each range. The spacing between the activated LEDs indicates the width of the set in-tune range. If the current in-tune range is ±49 cents, then the LEDs A and G#, FIG. 6, are turned on.

In the next step 116, a range display timer or timer-2 is set. The range display timer is set for a duration equal to a selected time for display of the in-tune range, for example about three seconds or any other shorter or longer desirable time period for indicating the in-tune range. From step 116, the program proceeds to step 118 where the program waits until the range switch 70 is found open whereupon step 120 determines if the time set in range display timer has expired. If true the program returns to the step in the main program of FIG. 4 following the point where the range subroutine was called. Otherwise the program proceeds to step 122 where it is determined if the calibration or range switch 70 is closed. When the switch 70 is open, the program continues to cycle through steps 120 and 122 until timer-2 expires. Thus when the tuner is powered up, the in-tune range is displayed for the duration of timer-2.

The musician can change the in-tune range by pressing the range push button switch 70 during the display of the in-tune range. Closing the range switch 70 causes the program to branch from step 122 to step 124 where it is determined if the present set in-tune range is the narrowest range in the possible in-tune ranges, for example plus or minus five cents in the table of FIG. 7. If false, the program in step 126 selects the next narrower range as the set in-tune range. Contrarily if true, the program in step 128 selects the broadest in-tune range such as plus or minus forty-nine cents in the example of FIG. 7. From step 126 or step 128, the program goes back to step 114 to change the in-tune range displayed by the display 22 to the new setting. Steps 116, 118, 120 and 122 are then repeated. By repeatedly depressing and releasing the range switch 70, the musician can successively select narrower tuning ranges until the narrowest range is selected whereupon the next operation of the switch 70 selects the broadest in-tune range.

Referring back to FIG. 4, after return from the range subroutine in step 112, the program in step 132 determines if the calibration or range switch 70 is closed. From the main program of FIG. 4, the musician by pressing the range switch 70 causes the program to branch from step 132 to step 134 which calls the range subroutine of FIG. 5 to display the in-tune range at anytime even when the tuner is detecting a tone. Furthermore re-pressing the range switch in rapid succession (before timer-2 expires) results in changing the in-tune range. As described above, the musician can thus select successively narrower in-tune ranges while timer-2 remains active in the range subroutine until the narrowest range is reached whereupon the next depression of the range switch selects the broadest range. From step 134 of FIG. 4, the program returns to the step 132.

When the range switch is found open in step 132, the program in step 138 determines if a tone is being sensed, for example, by determining if the output of the zero crossing detector 36 is a repeating pattern. When an incoming tone is present, the processor then begins procedure 140 to determine the fundamental frequency of the input signal from the transducer 30. The procedure 140 is a conventional procedure wherein the arriving output of the zero crossing detector 36 is used by the processor 38 to determine the fundamental frequency. For example, the fundamental frequency can be determined by first determining the appropriate octave and then determining the cent value (logarithmic) relative to the note "A" in that octave. After determining the fundamental frequency of the tone, the nearest standard musical note on a stored scale of notes is determined in step 142. Alternatively, step 142 can determine the nearest note by a conventional algorithm based upon frequency or cent value of one note, for example "A" in the corresponding octave. Next in step 144, it is determined if the sensed frequency is above the nearest standard note by more than the set upper limit of the in-tune range, for example see FIG. 7 wherein the set upper limit is one of the limits of plus 49, 40, 30, 20, 10 or 5 cents above the standard note. If step 144 is true, the red LED of that standard note is turned on in step 146. Otherwise the program proceeds to step 148 where it is determined if the sensed frequency is below the nearest standard note by more than the set lower limit of the in-tune range, such as below the standard note by more than minus 49, 40, 30, 20, 10 or 5 cents. If step 148 is true the program will proceed to step 150 where both the red and green LEDs corresponding to the nearest standard note are turned on. The mixture of red and green gives an amber color. From step 146 or step 150, the program proceeds to step 152 where the corresponding LED or LEDs are turned off and on at a blink rate which is proportional to the absolute value of difference of the tone frequency from the nearest standard note. If steps 144 and 148 are both false, the program in step 154 turns on the green LED; i.e., the green LED indicates that the fundamental frequency of the tone being sensed is within the set range (plus or minus the corresponding window width of FIG. 7) of the nearest musical note. Additionally the green note is maintained on steady and not turned on and off at any blink rate to contrast the green in-tune condition from the out-of-tune conditions of sharpness (red) and flat (amber).

After operating the appropriate LED, the program in step 156 determines if the timer-1 set in step 100 is now expired. If time has expired the program proceeds to the power down procedure 96 where any LEDs are turned off. Additionally in the power down procedure 96, the energization of the processor is placed in a minimum or quiescent power condition, and where appropriate, other circuit components are turned off. When step 156 is false, the program in step 158 determines if the power push button switch 72 has been operated. If it is now pressed the unit is powered down by the power down procedure 96. Thus the power switch 72 acts as a toggle with the first press turning the unit on and a successive depression turning the unit off. If false, then the program branches back to step 132 to begin another cycle.

When no incoming tone is detected in step 138, the program branches to step 170 where the corresponding red LEDs of LEDs 24 for the set range, such as in the table of FIG. 7, are flashed or blinked. The dual blinking red LEDs indicate the idle condition, and the spacing between the blinking LEDs indicates the set in-tune range. A slow blink rate, such a one second or other long duration delay between flashes, is easily recognized as the idle state where no incoming tone is sensed.

Aspiring musicians playing wind instruments in bands and orchestras can improve their intonation by playing long steady tones while watching the tuner. By practicing various techniques during tuner operation, the musician can determine which techniques make the instrument more sharp and which make the instrument more flat. Beginning students are challenged to keep their instrument in tune even with the widest window. As proficiency improves, narrower windows are selected to further improve intonation. In time, students become accustomed to hearing the correct pitches and to experiencing the necessary techniques needed to play in tune. The assistance provided by watching the tuner during long tones make learning to play a band instrument easier and faster.

Since many variations, modifications and changes in detail can be made to the above described embodiments, it is intended that the foregoing description and the accompanying drawings be interpreted as only illustrative and not as limiting to the scope and spirit of the invention as defined in the following claims.

What is claimed is:

1. An electronic tuning device for a musical instrument comprising;

a transducer for converting an acoustic tone played by the musical instrument into electrical signals;

frequency determination means for determining a fundamental frequency of said electrical signals and thus determining a fundamental frequency of said musical tone;

in-tune range setting means for selecting one of a plurality of different width ranges for the musical instrument to be in-tune;

computing means for computing a nearest musical note to said fundamental frequency of said musical tone and for determining an in-tune status whether or not the fundamental frequency is within the selected in-tune range of the nearest musical note;

a display including a row of individual light sources corresponding to respective musical notes;

first mode means responsive to the computing means for operating a light source in the row of light sources corresponding to the computed nearest musical note in a manner indicating the in-tune status; and second mode means for operating the individual light sources in the display to indicate the selected in-tune range.

2. An electronic tuning device as claimed in claim 1 wherein the second mode means operates pairs of light sources in the row of light sources so that the spacing between each operated pair of light sources is indicative of the selected in-tune range.

3. An electronic tuning device as claimed in claim 2 wherein the second mode means blinks each operated pair of light sources.

4. An electronic tuning device as claimed in claim 3, wherein each of said light sources is adapted to produce three colors; and the first mode means operates the operated light source to produce one color when said fundamental frequency of the musical tone is above the selected in-tune range of the computed nearest musical note, operates the operated light source to produce a second color when said fundamental frequency of the musical tone is below the selected range of the computed nearest musical note, and operates the operated light source to produce a third color when said fundamental frequency of the musical tone is within the selected range of the computed nearest musical note; and the second mode means operates each pair of operated light sources to produce the third color.

5. An electronic tuning device as claimed in claim 4 wherein each of said light sources includes red and green light emitting diodes, one of said three colors being red, another of said three colors being a combination of red and green, and the other of said three colors being green.

6. An electronic tuning device as claimed in claim 1 wherein the in-tune range setting means includes a push button switch, and means responsive to depression of the push button switch for selecting another of the plurality of in-tune ranges.

7. An electronic tuning device as claimed in claim 6 wherein the depression of a push button switch selects the next narrower in-tune range except when the present in-tune range is the narrowest range and then the broadest in-tune range is selected.

8. An electronic tuning device as claimed in claim 6 wherein the second mode means is operated by a first depression of the push button switch, and includes a timer which is set by operation of the second mode means; and wherein the in-tune setting means is operable only during the operation of the timer.

9. An electronic tuning device as claimed in claim 8 wherein the second mode means is momentarily operated during power up of the tuning device.

* * * * *